US009070324B2

(12) United States Patent
Kusafuka et al.

(10) Patent No.: US 9,070,324 B2
(45) Date of Patent: Jun. 30, 2015

(54) IMAGE DISPLAY APPARATUS AND DRIVING METHOD THEREOF

(75) Inventors: Kaoru Kusafuka, Kanagawa (JP); Shinji Takasugi, Yamato (JP); Taro Hasumi, Yamato (JP)

(73) Assignee: LG DISPLAY CO., LTD., Seoul (KR)

( * ) Notice: Subject to any disclaimer, the term of this patent is extended or adjusted under 35 U.S.C. 154(b) by 1443 days.

(21) Appl. No.: 12/057,280

(22) Filed: Mar. 27, 2008

(65) Prior Publication Data

US 2008/0180422 A1 Jul. 31, 2008

Related U.S. Application Data

(63) Continuation of application No. PCT/JP2006/319023, filed on Sep. 26, 2006.

(30) Foreign Application Priority Data

Sep. 30, 2005 (JP) ..... 2005-287045

(51) Int. Cl.
*G09G 3/30* (2006.01)
*G09G 3/32* (2006.01)

(52) U.S. Cl.
CPC ..... *G09G 3/3283* (2013.01); *G09G 3/3291* (2013.01); *G09G 2300/0819* (2013.01); *G09G 2300/0842* (2013.01); *G09G 2300/0866* (2013.01); *G09G 2310/0262* (2013.01)

(58) Field of Classification Search
None
See application file for complete search history.

(56) References Cited

U.S. PATENT DOCUMENTS

| | | | | |
|---|---|---|---|---|
| 6,583,775 | B1 | 6/2003 | Sekiya et al. | |
| 7,173,586 | B2 * | 2/2007 | Osame et al. | 345/82 |
| 2003/0112231 | A1 * | 6/2003 | Kurumisawa | 345/212 |
| 2004/0174354 | A1 * | 9/2004 | Ono et al. | 345/204 |
| 2005/0083270 | A1 * | 4/2005 | Miyazawa | 345/76 |
| 2005/0156837 | A1 * | 7/2005 | Kasai | 345/77 |
| 2005/0242746 | A1 * | 11/2005 | Miyagawa et al. | 315/169.3 |
| 2007/0018917 | A1 * | 1/2007 | Miyazawa | 345/76 |

FOREIGN PATENT DOCUMENTS

| | | | |
|---|---|---|---|
| JP | 2001060076 | A | 3/2001 |
| JP | 2003-140612 | A | 5/2003 |

(Continued)

OTHER PUBLICATIONS

R.M.A. Dawson et al. "Design of an Improved Pixel for a Polysilicon Active-Matrix Organic LED Display" SID 98 Digest, 1998, pp. 11-14.
S. Ono et al. "Pixel Circuit for a-Si AM-OLED" Proceedings of IDW 2003, pp. 255-258.
International Search Report for corresponding WO application No. PCT/JP2006/319023 lists the references above.

(Continued)

*Primary Examiner* — Seokyun Moon
(74) *Attorney, Agent, or Firm* — Birch, Stewart, Kolasch & Birch, LLP

(57) ABSTRACT

An image display apparatus includes a light emitting unit that emits light by current flowing through the light emitting unit; and a driver unit that includes a first terminal and a second terminal. The driver unit has a characteristic that an absolute value of a current flowing through the second terminal increases with a potential of the first terminal to the second terminal, and controls light emission of the light emitting unit based on a potential difference between the first terminal and the second terminal. The image display apparatus also includes a control unit that controls the potential of the first terminal to the second terminal of the driver unit to a value lower than a threshold voltage of the driver unit.

2 Claims, 10 Drawing Sheets

(56) References Cited

FOREIGN PATENT DOCUMENTS

| | | | |
|---|---|---|---|
| JP | 2003330421 | A | 11/2003 |
| JP | 2004280059 | A | 10/2004 |
| JP | 2005208229 | A | 8/2005 |
| JP | 2005208589 | A | 8/2005 |
| JP | 2005234242 | A | 9/2005 |

OTHER PUBLICATIONS

Japanese language office action dated Aug. 23, 2011 and its English language translation for corresponding Japanese application 2007516864 cites the foreign patent document above.

* cited by examiner

IMAGE DISPLAY APPARATUS AND DRIVING METHOD THEREOF

CROSS-REFERENCE TO RELATED APPLICATIONS

This application is a continuation of PCT international application Ser. No. PCT/JP2006/319023 filed Sep. 26, 2006 which designates the United States, incorporated herein by reference, and which claims the benefit of priority from Japanese Patent Application No. 2005-287045, filed Sep. 30, 2005, incorporated herein by reference.

BACKGROUND OF THE INVENTION

1. Field of the Invention

The present invention relates to an image display apparatus such as an organic EL display apparatus, and a driving method thereof.

2. Description of the Related Art

Conventionally, there has been proposed an image display apparatus using a current-controlling organic electroluminescence (EL) element having a function of generating light by recombining positive holes and electrons implanted into a light emitting layer.

In this type of image display apparatus, thin-film transistors (hereinafter, "TFT") including amorphous silicon and polycrystalline silicon and organic light emitting diode hereinafter "OLED"), as one of organic EL elements constitute each pixel. Brightness of each pixel is controlled by setting a proper current to each pixel.

In an active-matrix image display apparatus having plural pixels with current-drive type light emitting elements such as OLEDs and driving transistors such as TFTs laid out in series, a current value flowing through the light emitting elements changes due to a variation of threshold voltages of driving transistors provided in the pixels, and brightness variation occurs. As methods of improving this phenomenon, there are a system of detecting in advance a threshold voltage of a driving transistor and controlling a current flowing through light emitting elements based on the detected threshold voltage as disclosed in one document (for example, R. M. A. Dawson et al. (1998) "Design of an Improved Pixel for a Polysilicon Active-Matrix Organic LED Display" SID 98 Digest, pp. 11-14.), and a detailed circuit configuration based on this system as disclosed in another document (for example, S. Ono et al. (2003) "Pixel Circuit for a-Si AM-OLED" Proceedings of IDW '03, pp. 255-258).

SUMMARY OF THE INVENTION

An image display apparatus according to an aspect of the present invention includes a light emitting unit that emits light by current flowing through the light emitting unit; a driver unit that includes a first terminal and a second terminal, has a characteristic that an absolute value of a current flowing through the second terminal increases with a potential of the first terminal to the second terminal, and controls light emission of the light emitting unit based on a potential difference between the first terminal and the second terminal; and a control unit that controls the potential of the first terminal to the second terminal of the driver unit to a value lower than a threshold voltage of the driver unit.

An image display apparatus according to another aspect of the present invention includes a light emitting unit that emits light by current flowing through the light emitting unit; a driver unit that includes a first terminal and a second terminal, has a characteristic that an absolute value of a current flowing through the second terminal increases with a decrease in a potential of the first terminal to the second terminal, and controls light emission of the light emitting unit based on a potential difference between the first terminal and the second terminal; and a control unit that controls the potential of the first terminal to the second terminal of the driver unit to a value higher than a threshold voltage of the driver unit.

An image display apparatus according to still another aspect of the present invention includes a light emitting unit that emits light by current flowing through the light emitting unit, a driver unit that includes a first terminal and a second terminal, and controls light emission of the light emitting unit based on a potential difference between the first terminal and the second terminal; and a control unit that applies a voltage to the first terminal or the second terminal of the driver unit during a light emission period of the light emitting unit. The control unit controls a voltage applied to the first terminal or the second terminal of the driver unit so that the voltage is different between a high gradation level of light emission brightness and a low gradation level of light emission brightness.

A method according to still another aspect of the present invention is of driving a display apparatus, that includes a light emitting unit and a driver unit, the driver unit including a first terminal and a second terminal, the driver unit having a characteristic that an absolute value of a current flowing through the second terminal increases with a potential of the first terminal to the second terminal, and the driver unit being electrically connected to the light emitting element. The method includes making the light emitting element emit light, in a state that a potential of the first terminal to the second terminal of the driver unit is set to a value lower than a threshold voltage of the driver unit.

A method according to still another aspect of the present invention is of driving a display apparatus that includes a light emitting unit and a driver unit, the driver unit including a first terminal and a second terminal, the driver unit having a characteristic that an absolute value of a current flowing through the second terminal increases with a decrease in a potential of the first terminal to the second terminal, and the driver unit being electrically connected to the light emitting element. The method includes making the light emitting element emit light, in a state that a potential of the first terminal to the second terminal of the driver unit is set to a value higher than a threshold voltage of the driver unit.

A method according to still another aspect of the present invention is of driving a display apparatus that included a light emitting unit and a driver unit, the driver unit including a first terminal and a second terminal, and the driver unit being electrically connected to the light emitting element. A voltage applied to the first terminal or the second terminal of the driver unit is different between a high gradation level of light emission brightness and a low gradation level of light emission brightness.

BRIEF DESCRIPTION OF THE DRAWINGS

FIG. 14 is a configuration example of a line driver that gives a control potential to the power supply line and the like.

DETAILED DESCRIPTION OF THE PREFERRED EMBODIMENTS

Exemplary embodiments of an image display apparatus according to the present invention will be explained below in detail with reference to the accompanying drawings. Note that the present invention is not limited to the embodiments.

Figure 1:
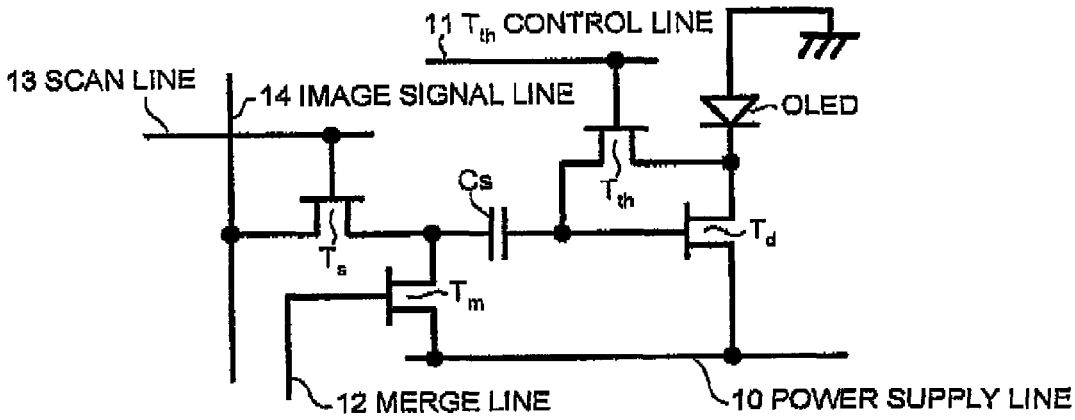
FIG. 1 a configuration diagram of a pixel circuit corresponding to one pixel of an image display apparatus for explaining a first embodiment of the present invention.

FIG. 1 is a configuration diagram of a pixel circuit corresponding to one pixel of an image display apparatus for explaining a first embodiment or the present invention. The pixel circuit shown in FIG. 1 includes an organic light-emitting diode (OLED), which is a type of an organic EL element, a driving transistor $T_d$, a threshold-voltage detecting transistor $T_{th}$, and switching transistors Ts and Tm that connect a threshold-voltage holding capacitor $C_s$ to a predetermined line for a predetermined period of time.

In FIG. 1 the driving transistor $T_d$ controls a current amount flowing through the OLED according to a potential difference between a gate electrode and a source electrode. The threshold-voltage detecting transistor $T_{th}$ has a function of electrically connecting between a gate electrode and a drain electrode of the driving transistor $T_g$ when the threshold-voltage detecting transistor $T_{th}$ is in the on state, and passing a current from the gate electrode to the drain electrode of the driving transistor $T_d$ until when a difference of potential applied to the gate electrode and potential applied to the source electrode of the driving transistor $T_d$ becomes a threshold voltage $V_{th}$ of the driving transistor $T_d$, thereby detecting the threshold voltage $V_{th}$ of the driving transistor $T_d$.

The OLED is an element through which a current flows and light is emitted when a potential difference (difference between potential applied to an anode and potential applied to a cathode) equal to or higher than a threshold voltage is generated in the OLED. Specifically, the OLED has a structure including at least an anode layer and a cathode layer formed by Al, Cu, and ITO (Indium Tin Oxide) etc., and a light emitting layer formed by organic materials such as phthalocyanine, tris aluminium complex, benzoquinolinolato, and beryllium complex between the anode layer and the cathode layer. The OLED has a function of generating light by reconnecting the positive holes and the electrons implanted into the light emitting layer. An organic light-emitting element capacitor COLED equivalently expresses the capacitor of the OLED.

The driving transistor $T_d$, the threshold-voltage detecting transistor $T_{th}$, the switching transistor Ts, and the switching transistor $T_m$ are thin-film transistors, for example. In each of the drawings to be referred, while a channel (n-type or p-type) of a thin-film transistor is not particularly specified, either n-type or p-type can be used.

A power supply line 10 supplies power to the driving transistor $T_d$ and the switching transistor $T_m$. A $T_{th}$ control line 11 supplies a signal to control the threshold-voltage detecting transistor $T_{th}$. A merge line 12 supplies a signal to control the switching transistor $T_m$. A scan line 13 supplies a signal to control the switching transistor $T_s$. An image signal line 14 supplies an image signal.

In FIG. 1, while the OLED is laid out between a high-potential ground line and the low-potential power source line 10, the high-potential side can be driven as the power supply line 10, the lower-potential side can be set as the ground line at a fixed potential, or both can be driven.

Figure 2:
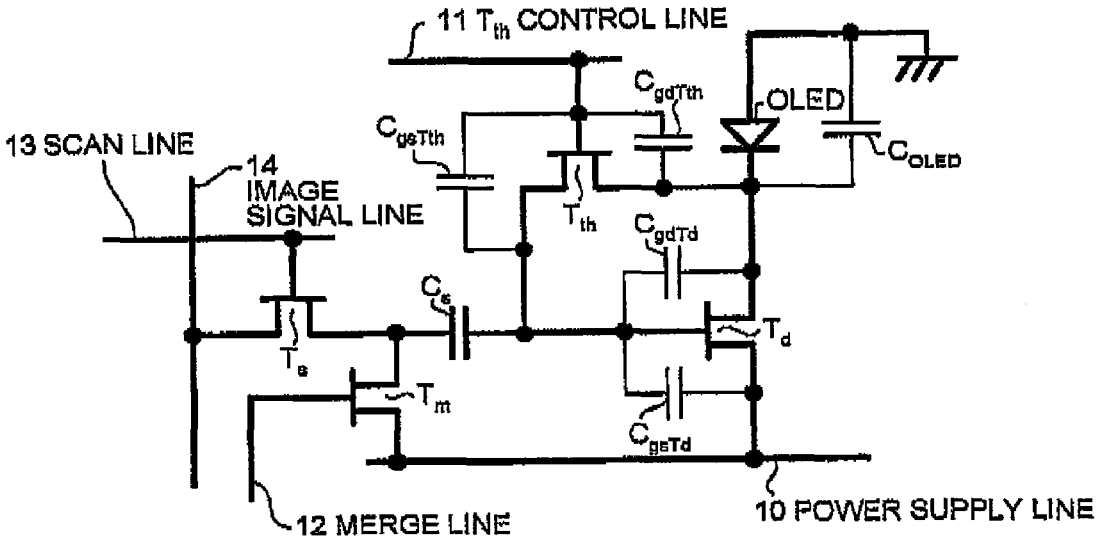
FIG. 2 is a circuit configuration diagram depicting a parasitic capacitor and an organic light-emitting element capacitor of a transistor on the pixel circuit shown in FIG. 1.

In general, a transistor has parasitic capacitors present between a gate and a source and between a gate and a drain. Among these parasitic capacitors, what affect the gate potential of the driving transistor $T_d$ are a capacitor $C_{gsTd}$ between the gate and the source of the driving transistor $T_d$, a capacitor $C_{gdTd}$ between the gate and the drain of the driving transistor $T_d$, and a capacitor $C_{gsTh}$ between the gate and the source of the threshold-voltage detecting transistor $T_{th}$. FIG. 2 depicts an addition of these parasitic capacitors and an organic light-emitting element capacitor $C_{OLED}$ that the OLED intrinsically holds.

Figure 3:
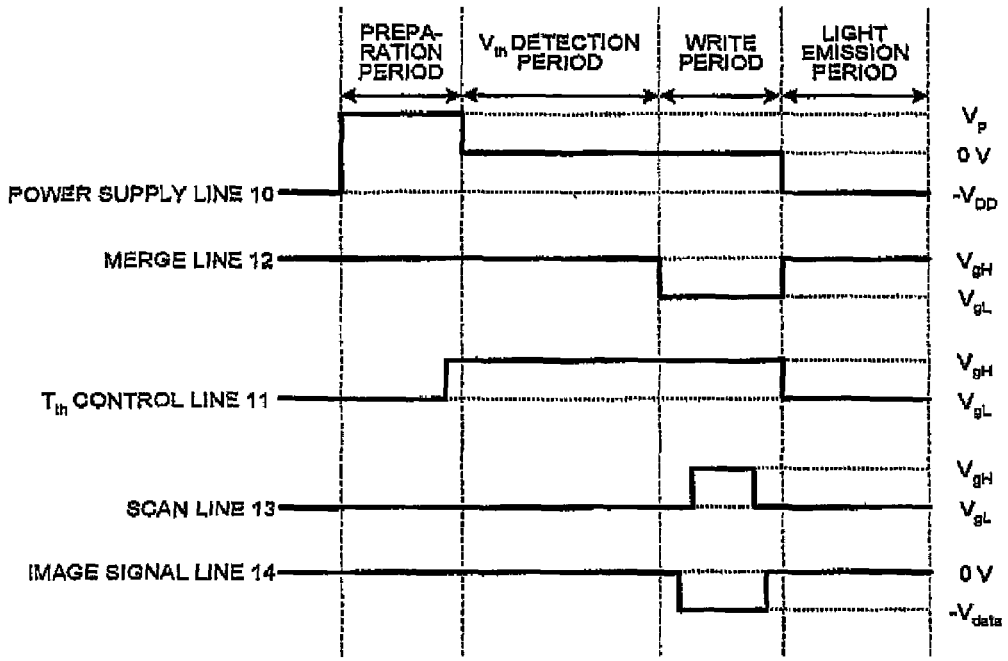
FIG. 3 is a sequence diagram for explaining a general operation of the pixel circuit shown in FIG. 2.

An operation in the first embodiment is explained next with reference to FIG. 3 to FIG. 7. FIG. 3 is a sequence diagram for explaining a general operation of the pixel circuit shown in FIG. 2. FIG. 4 to FIG. 7 are schematic diagrams for respectively explaining the operation of a preparation period separated into four periods (FIG. 4), a threshold voltage detection period (FIG. 5), a write period (FIG. 6), and a light emission period (FIG. 7). The operation explained below is performed under the control of a control unit (not shown).

Preparation Period

Figure 4:
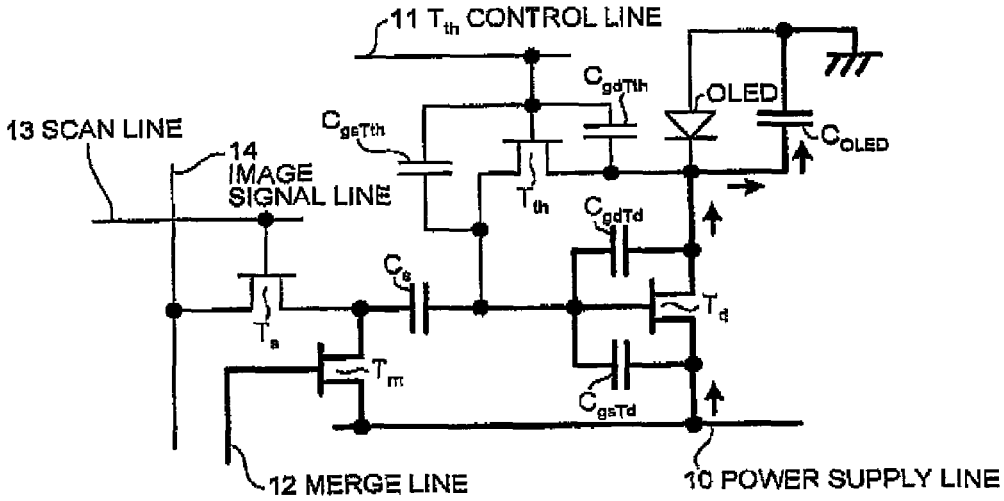
FIG. 4 is a schematic diagram for explaining an operation of a preparation period shown in FIG. 3.

The operation during the preparation period is explained with reference to FIG. 3 and FIG. 4. During the preparation period, the power supply line 10 is set to a high potential ($V_p$), the merge line 12 is set to a high potential ($V_{gH}$), the $T_{th}$ control line 11 is set to a low potential ($V_{gL}$), the scan line 13 is set to the low potential ($V_{gL}$), and the image signal line 14 is set to a zero potential. Accordingly, as shown in FIG. 4, the threshold-voltage detecting transistor $T_{th}$ becomes off, the switching transistor $T_s$ becomes off, the driving transistor $T_d$ becomes on, and the switching transistor Tm becomes on. A current flows in the route of the power supply line 10 to the driving transistor $T_d$ to the organic light-emitting element capacitor $C_{OLED}$, and charge is accumulated in the organic light-emitting element capacitor $C_{OLED}$. A reason why charge is accumulated in the organic light-emitting element capacitor $C_{OLED}$ during this preparation period is that the organic light-emitting element capacitor $C_{OLED}$ is operated as a supply source of power passing between the drain and the source of the driving transistor $T_d$ at the time of detecting a state that a current between the drain and the source (hereinafter, "$I_{ds}$") of the driving transistor $T_d$ does not flow during a threshold-voltage detection period described later (a state that the voltage between the gate and the source of the driving transistor Td is equal to a threshold voltage).

Threshold-Voltage Detection Period

Figure 5:
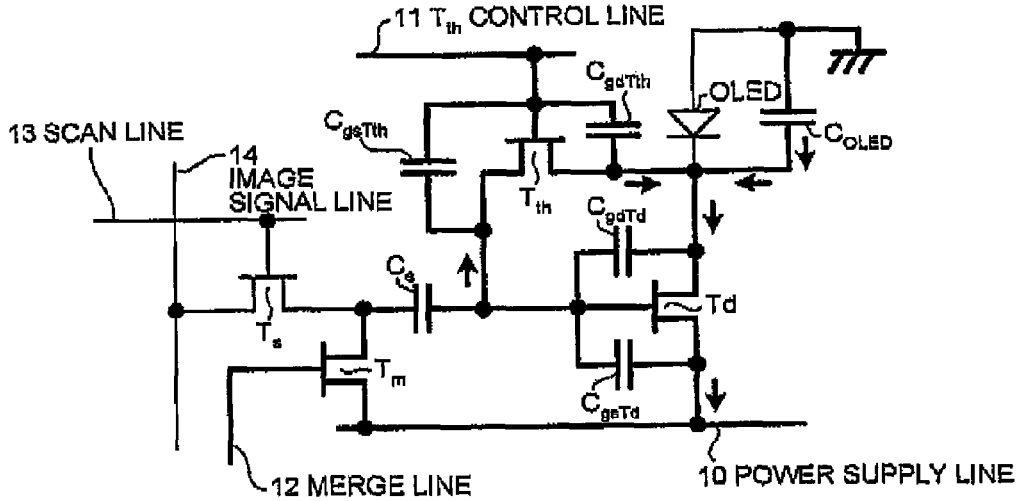
FIG. 5 is a schematic diagram for explaining an operation of a threshold voltage detection period shown in FIG. 3.

Next, the operation during the threshold-voltage detection period is explained with reference to FIG. 3 and FIG. 5. During the threshold-voltage detection period, the power supply line 10 is set to a zero potential, the merge line 12 is set to the high potential ($V_{gH}$), the $T_{th}$ control line 11 is set to the high potential ($V_{gH}$), the scan line 13 is set to the low potential ($V_{gL}$), and the image signal line 14 is set to a zero potential. Accordingly, as shown in FIG. 5S the threshold-voltage detecting transistor $T_{th}$ becomes on, and the gate and the drain of the switching transistor are connected to each other.

Charge accumulated in the threshold-voltage holding capacitor $C_s$ and in the organic light-emitting element capacitor $C_{OLED}$ is discharged, and a current flows through the driving transistor $T_d$ to the power supply line 10. When a potential difference between the gate and the source of the driving transistor $T_d$ reaches the threshold voltage $V_{th}$, the driving transistor $T_d$ becomes off, and the threshold voltage $V_{th}$ of the driving transistor $T_d$ is detected.

Write Period

The operation during the write period is explained next with reference to FIG. 3 and FIG. 6. During the write period, data potential ($-V_{data}$) is supplied to the threshold-voltage holding capacitor $C_s$, thereby varying the gate potential of the driving transistor $T_d$ to a desired potential. Specifically, the power supply line 10 is set to a zero potential, the merge line 12 is set to the low potential ($V_{gL}$), the $T_{th}$ control line 11 is set to the high potential ($V_{gH}$), the scan line 13 is set to the high potential ($V_{gH}$), and the image signal line 14 is set to the data potential ($-V_{data}$).

Figure 6:
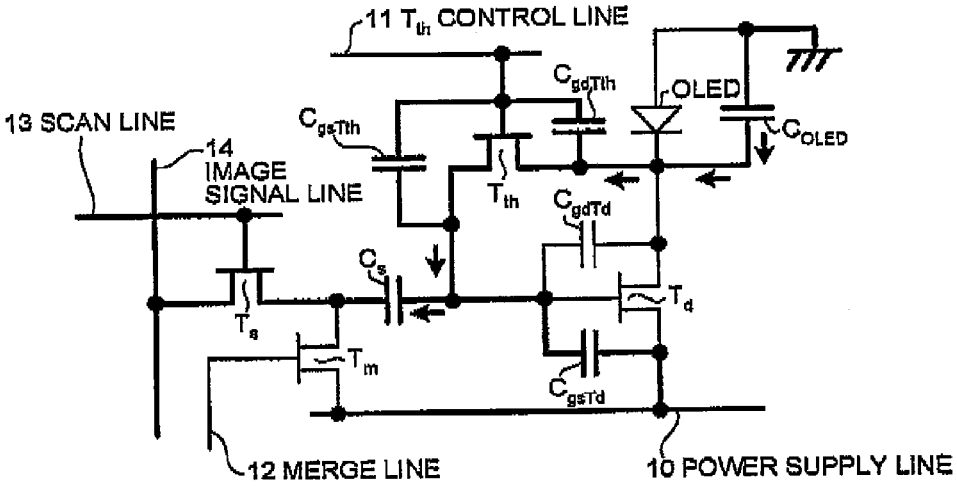
FIG. 6 is a schematic diagram for explaining an operation of a write period shown in FIG. 3.
Figure 7:
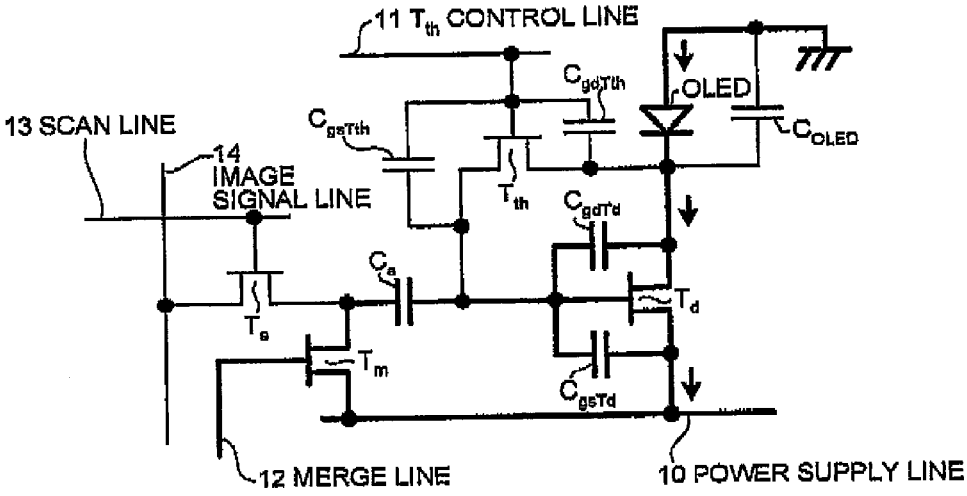
FIG. 7 is a schematic diagram for explaining an operation of a light emission period shown in FIG. 3.

Accordingly, as shown in FIG. 6, the switching transistor $T_s$ becomes on, and the switching transistor $T_m$ becomes off, and the charge accumulated in the organic light-emitting element capacitor $C_{OLED}$ is discharged. A current flows in the route of the organic light-emitting element capacitor $C_{OLED}$ to the threshold-voltage detecting transistor $T_{th}$ to the threshold-voltage holding capacitor $C_s$, and charge is accumulated in the threshold voltage holding capacitor $C_s$. In other words, the charge accumulated in the organic light-emitting element capacitor $C_{OLED}$ moves to the threshold-voltage holding capacitor $C_s$.

A gate voltage $V_g$ of the driving transistor $T_d$ is expressed by the following equation, when the threshold voltage of the driving transistor $T_d$ is $V_{th}$, when the capacitance of the threshold-voltage holding capacitor $C_s$ is $C_s$, and when the total capacitance when the threshold-voltage detecting transistor $T_{th}$ becomes on (in other words, electrostatic capacitance and parasitic capacitance of the capacitors connected to the gate of the driving transistor $T_d$) is $C_{all}$ (the above assumption is also applied to all of the following equations).

$$V_g=V_{th}-(C_s/C_{all})\cdot V_{data} \quad (1)$$

A potential difference $V_{Cs}$, between both ends of the threshold-voltage holding capacitor Cs is expressed by the following equation.

$$V_{Cs}-V_g-(-V_{data})=V_{th}+[(C_{all}-C_s)/C_{all}]\cdot V_{data} \quad (2)$$

The total capacitance $C_{all}$ shown by the above equation (2) is the total capacitance when the threshold-voltage detecting transistor $T_{th}$ is conductive, and is expressed by the following equation.

$$C_{all}=C_{OLED}+C_s+C_{gsTth}+C_{gdTth}+C_{gsTd} \quad (3)$$

A reason why the above equation (3) does not contain the capacitance of the capacitor $C_{gdTd}$ between the gate and the drain of the driving transistor $T_d$ is that the gate and the drain of the driving transistor $T_d$ are connected to each other via the threshold-voltage detecting transistor $T_{th}$, and both ends of the driving transistor $T_d$ are at approximately the same potentials. A relationship of $C_s<C_{OLED}$ is present between the threshold-voltage detecting transistor $T_{th}$ and the organic light-emitting element capacitor $C_{OLED}$.

Light Emission Period

Last, the operation during the light emission period is explained with reference to FIG. 3 and FIG. 7. During the light emission period, the power supply line 10 is set to the minus potential ($-V_{DD}$), the merge line 12 is set to the high potential ($V_{gH}$), the $T_{th}$ control line 11 is set to the low potential ($V_{gL}$), the scan line 13 is set to the low potential ($V_{gL}$), and the image signal line 14 is set to a zero potential.

Accordingly, as shown in FIG. 7, the driving transistor $T_d$ becomes on, the threshold-voltage detecting transistor $T_{th}$ becomes off, and the switching transistor $T_s$ becomes off. A current flows through the route of the OLED to the driving transistor $T_d$ to the power supply line 10, and the OLED emits light.

In this case, a current flowing from the drain to the source of the driving transistor $T_d$ (that is $I_{ds}$) is expressed using a constant β determined by the structure and the material of the driving transistor $T_d$, a potential difference $V_{gs}$ between the gate and the source based on the source of the driving transistor $T_d$, and the threshold voltage $V_{th}$ of the driving transistor $T_d$.

$$I_{ds}=(\beta/2)\cdot(V_{gs}-V_{th})^2 \quad (4)$$

To review a relationship between the potential difference $V_{gs}$ and the current $I_{ds}$ between the gate and the source of the driving transistor $T_d$, the potential difference $V_{gs}$ when the parasitic capacitor of the pixel circuit is not considered is calculated. In FIG. 7, the driving transistor $T_d$ is conductive at the light emitting time, and the source potential and the drain potential of the driving transistor $T_d$ are held at approximately equal potentials. The gate potential of the driving transistor $T_d$ is in the state that the writing potential ($-V_{data}$) is divided between the threshold-voltage holding capacitor Cs and the organic light-emitting element capacitor $C_{OLED}$. Therefore, the potential difference $V_{gs}$ can be expressed by the following equation.

$$V_{gs}=V_{th}+[C_{OLED}/(C_s+C_{OLED})]\cdot V_{data} \quad (5)$$

Therefore, a relationship between the potential difference $V_{gs}$ and the current Ids between the gate and the source of the driving transistor $T_d$ is expressed as follows using the above equations (4) and (5).

$$I_{ds}=(\beta/2)\cdot([C_{OLED}/(C_s+C_{OLED})]\cdot V_{data})^2=a\cdot V_{data} \quad (6)$$

According to the equation (6), the current $I_{ds}$ does not depend on the threshold voltage $V_{th}$, and is proportional to a square of the writing potential.

However, recently, the present inventors have found that near $V_{th}$, the actual measurement value of the current Ids is larger than the value obtained from the above calculation equation (equation (6)).

Figure 8:
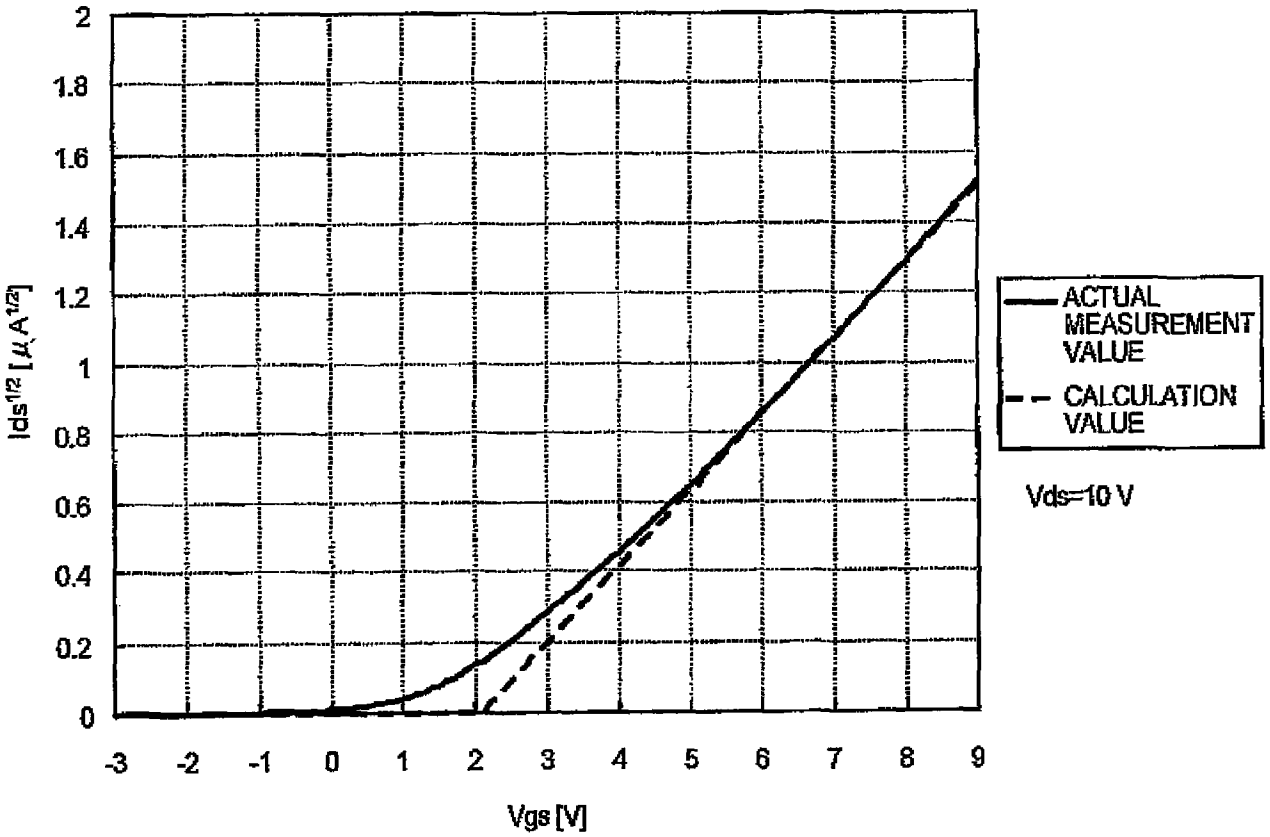
FIG. 8 depicts a relationship ($V-I^{1/2}$ characteristic) between a current $(I_{ds})^{1/2}$ and a potential difference Vgs between a gate and a source of a driving transistor.

For example, FIG. 8 depicts a relationship ($V-I^{1/2}$ characteristic) between a current $(I_{ds})^{1/2}$ and the potential difference $V_{gs}$ between the gate and the source of the driving transistor $T_d$. In FIG. 8, a solid line waveform shows one example of the actual measurement value, and a broken line waveform shows a calculation value showing characteristics following the above equation (6). In FIG. B, a vertical axis represents $(I_{ds})^{1/2}$, and a lateral axis represents $V_{gs}$. As characteristics of a transistor, there are a saturation area where $I_{ds}$ is approximately constant against a change of the potential difference $V_{ds}$ between the drain and the source of the transistor and a linear area where $I_{ds}$ changes approximately linearly against a change of $V_{ds}$. In the saturation area, $(I_{ds})^{1/2}$ changes linearly against a change of $V_{gs}$. In FIG. 8, $(I_{ds})^{1/2}$ changes linearly in the area of $V_{gs}$>6 V, and it is clear that the area is the saturation area where $V_{gs}$>6 V. Although not shown in FIG. 8, when $V_{gs}$ is increased, the area becomes a linear area out of the straightened change of $(I_{ds})^{1/2}$.

A maximum value of an inclination of a change of $(I_{ds})^{12}$ to $V_{gs}$ is present in the saturation area. When this inclination becomes a maximum, a tangent of a $V-I^{1/2}$ characteristic curve where this inclination becomes the maximum is a straight line of the calculation value in FIG. 8, and an intersection between this straight line and the lateral axis ($(I_{ds})^{1/2}=0$) becomes the threshold voltage $V_{th}$ of the driving transistor $T_d$. As shown in FIG. 8, the actual measurement value is greatly different from the calculation value near (for example, within a range of ±2 volts of the threshold voltage $V_{th}$) the threshold voltage $V_{th}$ (the threshold voltage $V_{th}$ is about 2 volts in the example of FIG. 8). Therefore, even when light emission control is performed based on a pixel level corrected using the threshold voltage $V_{th}$ detected in advance, the current $I_{ds}$ near the threshold voltage $V_{th}$ does not become sufficiently small. Consequently, brightness of the pixel level (low gradation level) near the threshold voltage does not become sufficiently small, and a contrast ratio of the image display apparatus becomes low.

In the first embodiment, when light emission control of the organic light emitting element is performed based on a pixel level corrected using the threshold voltage $V_{th}$ of the driving transistor $T_d$, and also when display control at the low gradation time is performed, potential of a predetermined wiring (for example, the power supply line and the $T_{th}$ control line) is changed from that of displaying the high gradation, thereby decreasing the potential difference $V_{gs}$ between the gate and the source of the driving transistor $T_d$.

A control method of varying the potential of a predetermined wiring (for example, the power supply line and the $T_{th}$ control line) during the light emission period is explained.

Figure 9:
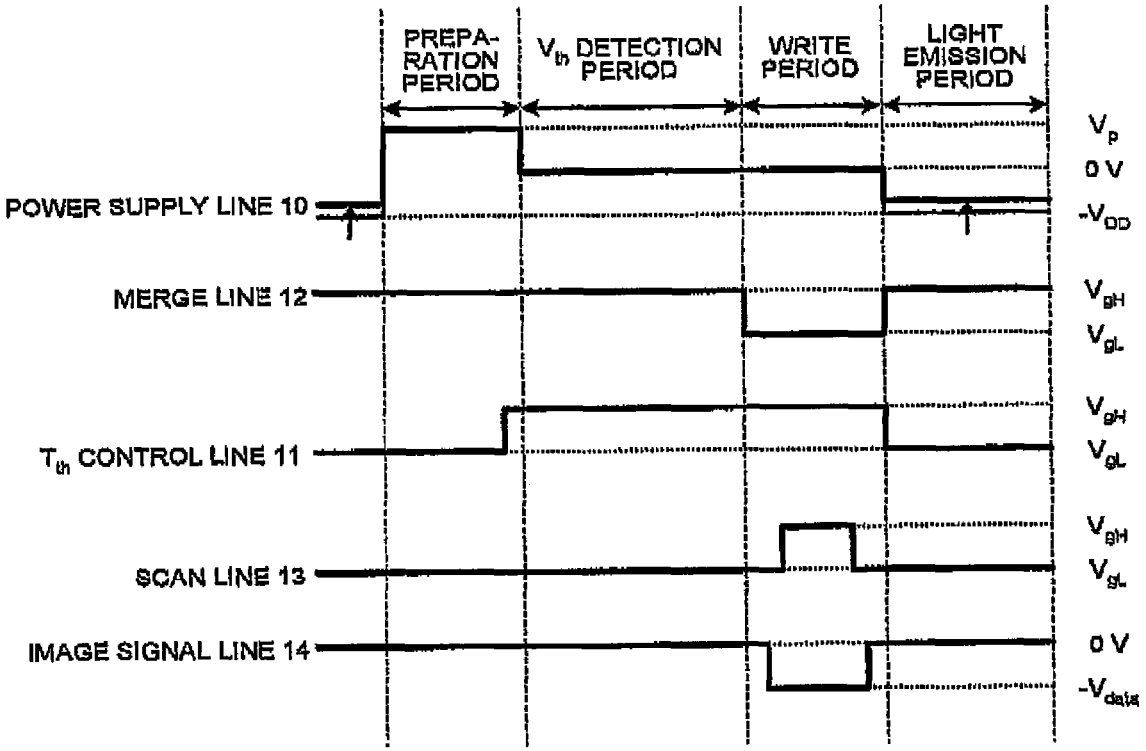
FIG. 9 is a sequence diagram for explaining a control method according to the first embodiment for the pixel circuit shown in FIG. 2.

FIG. 9 is a sequence diagram for explaining the control method in a first example of the pixel circuit shown in FIG. 2. The sequence diagram in FIG. 9 is different from that shown in FIG. 3 in that, during the light emission period, the potential of the power supply line 10 is increased by a predetermined amount to decrease the voltage applied to the drain and the source of the driving transistor $T_d$. By increasing the potential of the power supply line 10 by a predetermined amount, the voltage applied to the drain and the source of the driving transistor $T_d$ decreases. Therefore, brightness at the low gradation level of the OLED decreases, and a desired contrast ratio can be obtained. By increasing the potential of the power supply line 10 in this way, when the light emission brightness of the light emitting element is particularly in low gradation, the potential of the gate to the source of the driving transistor $T_d$ can be made lower than the threshold voltage of the driving transistor $T_d$, and the current flowing to the light emitting element can be made smaller at the time of displaying a black level.

While the driving transistor $T_d$ is explained as the n-type in the first embodiment, when the driving transistor Td is the p-types the absolute value of the current $I_{ds}$ becomes larger when the potential of the gate to the source of the driving transistor $T_d$ becomes smaller. Therefore, when the driving transistor $T_d$ is the p-type, it is preferable that the potential of the gate to the source of the driving transistor $T_d$ is set higher than the threshold voltage of the driving transistor $T_d$.

Next, a quantitative value at the time of increasing the potential of the power supply line 10 is made clear. The above equations (5) and (6) express the potential difference $V_{gs}$ and the current $I_{ds}$ between the gate and the source of the driving transistor $T_d$ in the image display apparatus when it is assumed that a parasitic capacitor is not present in the pixel circuit. However, because the above parasitic capacitor is present in the actual pixel circuit, the potential difference $V_{gs}$ and the current $I_{ds}$ receive the influence of the threshold voltage $V_{th}$. Therefore, to obtain the quantitative value when the parasitic capacitor is considered, the potential difference $V_{gs}$ and the current $I_{ds}$ when considering the parasitic capacitor are calculated like the equations (5) and (6).

Assume that the gate potential of the driving transistor $T_d$ is $V_g$. In this case, the gate potential $V_{gs}$ to the source of the driving transistor $T_d$ is expressed by the following equation.

$$V_{gs}=V_g+V_{DD}-V_{thOLED} \tag{7}$$

Capacitances connected to the gate of the driving transistor $T_d$ are the holding capacitor $C_s$ and the three parasitic Capacitors $C_{gsTth}$, $C_{gsTd}$, and $C_{gdTd}$. When the potential of the power supply line 10 is changed from "$-V_{DD}$" to "$-V_{DD}+\Delta v$", a new gate potential $V_g'$ of the driving transistor $T_d$ is give by the following equation.

$$V_g'=V_g+[(C_s+C_{gsTd})/(C_s+C_{gsTd}+C_{gdTd}+C_{gsTth})]\cdot\Delta v \tag{8}$$

As a result, a new gate potential $V_{gs}'$ to the source is given by the following equation.

$$\begin{aligned} V_{gs}' &= V_g' + V_{DD} - \Delta v - V_{thOLED} \\ &= V_{gs} - [(C_{gdTd} + C_{geTth})/(C_s + C_{gsTd} + C_{gdTd} + C_{goTth})]\cdot\Delta v \end{aligned} \tag{9}$$

It is known from the equation (9) that the gate potential becomes lower than $V_{gs}$ by a constant time of Δv, and the contrast ratio of the image display apparatus can be improved by varying the potential of the power supply line 10 based on the above equation.

As a method of increasing the potential of the power supply line 10 by Δv, there is considered a method of applying an auxiliary voltage pulse corresponding to Δv to the power supply line 10 during the light emission period, instead of a reference voltage pulse usually applied to the power supply line 10.

Figure 13:
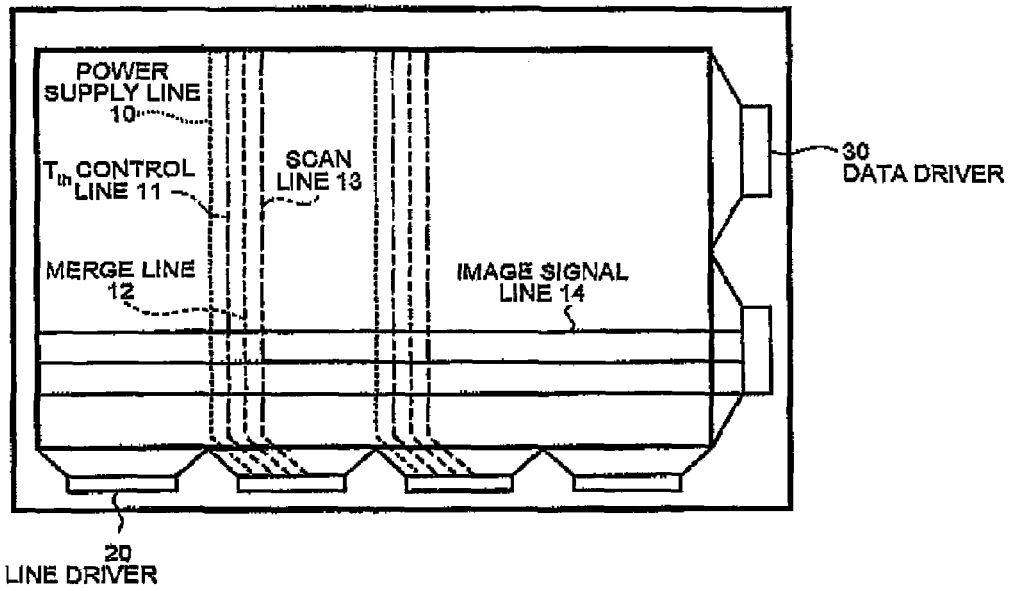
FIG. 13 is a configuration example of a control unit that increases a potential of a power supply line.
Figure 14:
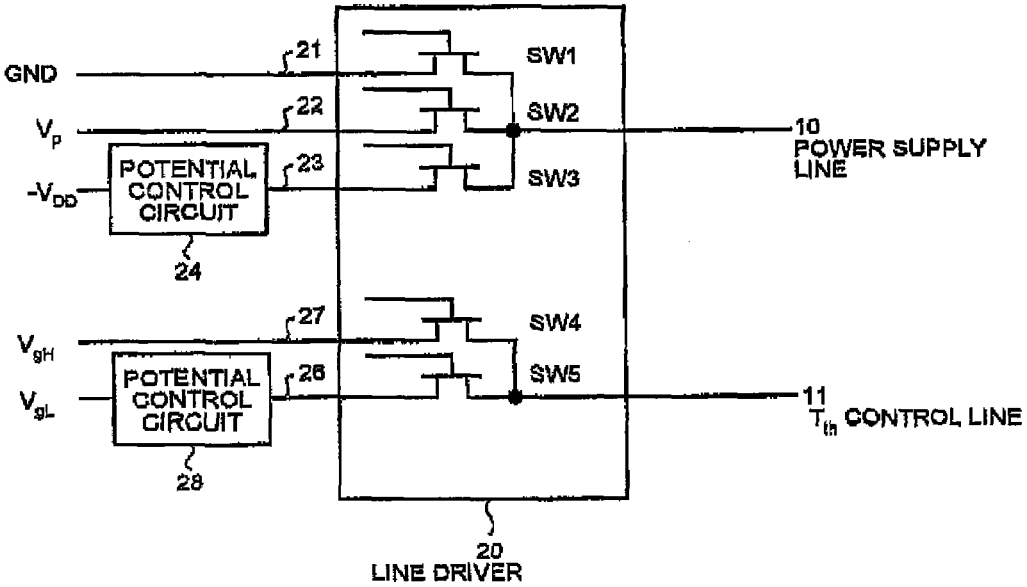

As a control unit that increases the potential of the power supply line 10, there is a line driver (Y driver) 20 connected to the power supply line, as shown in FIG. 13. The line driver 20 includes switching elements SW1 to SW3 within a driving IC, inside the line driver 20, as shown in FIG. 14. The switching elements SW1 to SW3 are connected to a first potential line 21 and a second potential line 22 that are held at constant potentials of GND and $v_p$, respectively, and to a third potential line 23 of which potential changes. By controlling the switching elements SW1 to SW3, it becomes possible to select a potential line connected to the power supply line 10, thereby varying the potential supplied to the power supply line 10. The third potential line 23 has one end connected to a constant power supply $-V_{DD}$ via a potential control circuit 24. When the potential control circuit 24 is driven based on the power supply control signal, a potential supplied to the third potential line 23 can be changed. For the potential control circuit 24, conventionally-known control circuits such as a variable resistance circuit and a pulse potential application circuit are employed. The third potential line 23 can be connected to the variable power supply instead of the constant power supply $-V_{DD}$.

The above explanation relates to a pixel circuit corresponding to one pixel of the image display apparatus. In the image display apparatus related to a multicolor display in which three primary-color pixels of red, green, and blue form one picture element or related to a similar multicolor display, it is general that light intensity necessary for a maximum gradation (white display) and light intensity per current are different for a light emitting element of each color. Therefore, when $V_{data}$ of a minimum gradation (black) is 0 V, $V_{data}$ of the maximum gradation (white) is different for each color pixel. However, when the width of $V_{data}$ of the minimum gradation (black) becomes small, a contrast ratio decreases. By arranging $V_{data}$ of the maximum gradation to the maximum voltage of the image signal, and by varying the reduction width of $V_{gs}$ for each color, a satisfactory white display can be obtained without decreasing the contrast ratio.

It is preferable that the condition for increasing the potential of the power supply line 10 is differentiated between when the light emission brightness of the OLED is at the low gradation level and when the light emission brightness of the OLED is at the high gradation level. More preferably, the change amount (increase amount) of the potential of the power supply line 10 is set large when the light emission brightness is at the low gradation level and is set small when the light emission brightness is at the high gradation level. The low gradation level and the high gradation level are not absolute values, and show a size relationship of light emission brightness at both levels. For example, to obtain a satisfactory white display and a desirable contrast ratio, at the time of varying the potential of the power supply line 10 based on the above processing method, assume that light emission brightness A when the change amount of the potential of the power supply line 10 is $\Delta V_A$ and light emission brightness B when the change amount of the potential of the power supply line 10 is $\Delta V_B$ have a relationship of $\Delta V_A > \Delta V_B$. In this case, the light emission brightness A can be set as the low gradation level, and the light emission brightness B can be set as the high gradation level.

The above explains the pixel circuit configured to have the OLED laid out between a high-potential ground line and a low-potential power supply line on the other hand, in the pixel circuit configured to have the OLED laid out between a high-potential power supply line and a low-potential ground line, the potential of the power supply line at the high-potential side is decreased by a predetermined amount. In other words, what is important is that the voltage applied to between the gate and the source of the driving transistor $T_d$ is controlled to decrease.

When the pixel circuit is configured to drive both the high-potential, side and the low-potential side, either both or one of the potential sides can be simultaneously controlled.

As explained above, according to the image display apparatus of the first embodiment, the potential of the power supply line is changed to lower the voltage application to the driving transistor that controls the light emission of the organic light-emitting element during the light emission period of the organic light emitting element. Therefore, light emission brightness of the organic light-emitting element at the low gradation level can be decreased. As a result, the contrast ratio in the image display apparatus can be improved.

Figure 10:
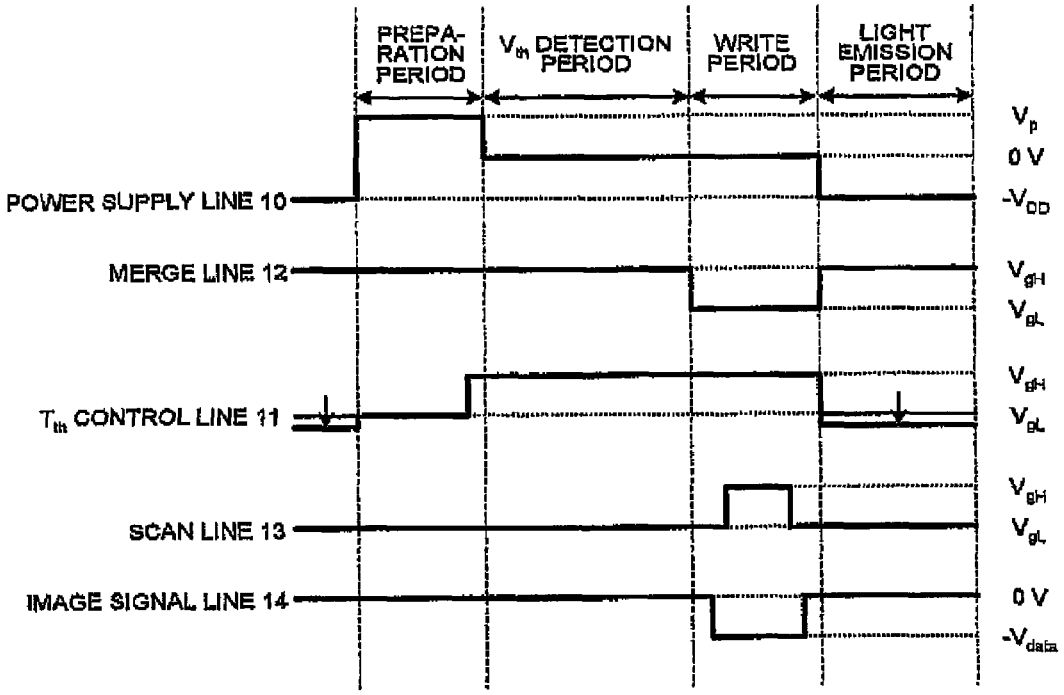
FIG. 10 is a sequence diagram for explaining a control method according to a second embodiment of the present invention for the pixel circuit shown in FIG. 2.

In the first embodiment, as shown in FIG. 9, the potential of the power supply line 10 is increased during the light emission period. On the other hand, in a second embodiment of the present invention, the potential of the $T_{th}$ control line 11 is dropped during the light emission period, as shown in FIG. 10.

In the configuration shown in FIG. 7, for example, the $T_{th}$ control line 11 is connected to the gate of the driving transistor $T_d$ via the capacitor $C_{gsTth}$ between the gate and the source of the threshold-voltage detecting transistor $T_{th}$. Therefore, when the potential of the $T_{th}$ control line 11 is decreased, the gate potential of the driving transistor $T_d$ also falls. Consequently, the contrast ratio in the pixel circuit can be improved like in the first embodiment.

In the image display apparatus of a multi-color display in which three primary-color pixels of red, green, and blue form one picture element, a satisfactory white display can be obtained without lowering the contrast ratio, by arranging $V_{data}$ of the maximum gradation to the maximum voltage of the image signal, and by varying the reduction range of $V_{gs}$ for each color, like in the first embodiment.

It is preferable that the condition for decreasing the potential of the $T_{th}$ control line 11 is differentiated between when the light emission brightness of the OLED is at the low gradation level and when the light emission brightness of the OLED is at the high gradation level. More preferably, the change amount (decrease amount) of the potential of the $T_{th}$ control line 11 is set large when the light emission brightness is at the low gradation level and is set small when the light emission brightness is at the high gradation level. The low gradation level and the high gradation level are not absolute values, and show a size relationship of light emission brightness at both levels. For example, to obtain a satisfactory white display and a desirable contrast ratio, at the time of varying the potential of the $T_{th}$ control line 11 based on the above processing method, assume that light emission brightness A when the change amount of the potential of the $T_{th}$ control line 11 is $\Delta V_A$ and light emission brightness B when the change amount of the potential of the $T_{th}$ control line 11 is $\Delta V_B$ have a relationship of $\Delta V_A > \Delta V_B$. In this case, the light emission brightness A can be set as the low gradation level, and the light emission brightness B can be set as the high gradation level.

As a control unit that changes the potential of the $T_{th}$ control line 11, there is the line driver (Y drives) 20 connected to the $T_{th}$ control line 11, as shown in FIG. 13. This line driver 20 includes switching elements SW4 and SW5 within the driving IC, inside the line driver 20, au shown in FIG. 14. The switching elements SW4 and SW5 are connected to a fourth potential line 26 of which potential is changed and a fifth potential line 27 that is held at a constant potential $V_{gH}$. A method of varying the potential of the fourth potential line 26 is similar to that of the third potential line 23, and the potential can be changed via a potential control circuit 28 connected to the constant potential $V_{gL}$ as shown in FIG. 14, for example.

A difference of control mode following the difference of configuration about whether to drive the high-potential side or the low-potential side or both is similar to that of the first embodiment. The potential of the $T_{th}$ control line 11 can be changed toward the direction determined according to the driving system.

As explained above, according to the image display apparatus of the second embodiment, the potential of the $T_{th}$ control line is changed to lower the voltage application to the driving transistor that controls the light emission of the organic light-emitting element during the light emission period of the organic light emitting element. Therefore, light emission brightness of the organic light-emitting element at the low gradation level can be decreased. As a result, the contrast ratio in the image display apparatus can be improved.

Figure 11:
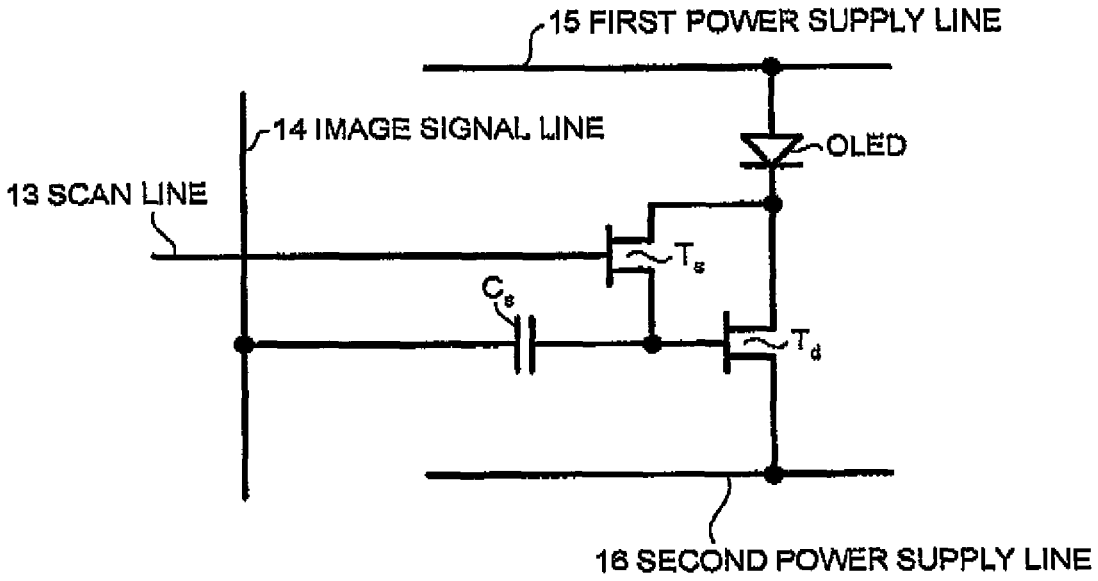
FIG. 11 depicts a configuration of a pixel circuit corresponding to one pixel of an image display apparatus for explaining a third embodiment of the present invention.
Figure 12:
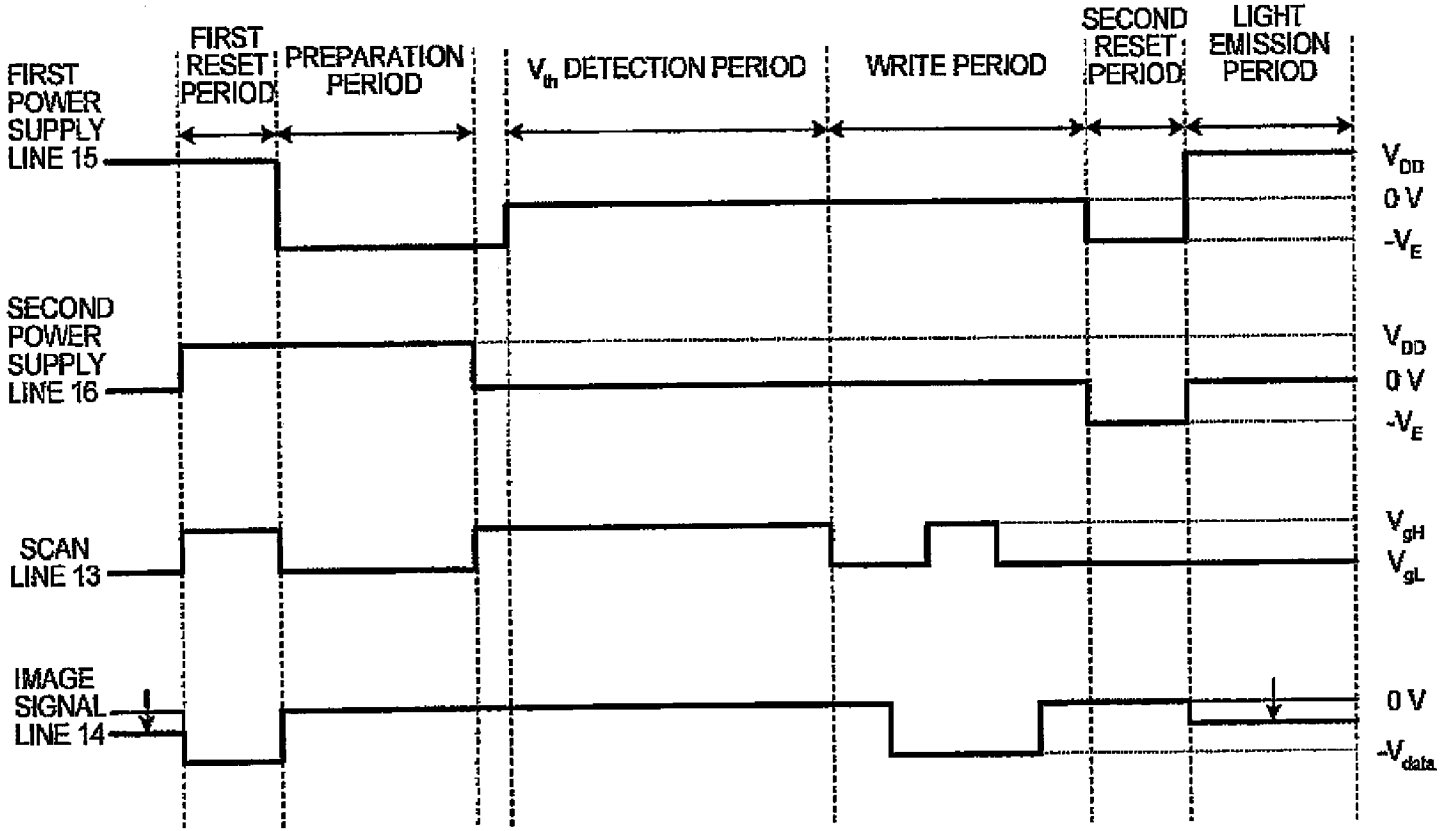
FIG. 12 is a sequence diagram for explaining a control method of a pixel circuit according to the third embodiment shown in FIG. 11.

In the second embodiment, the potential of the $T_{th}$ control line 11 is decreased during the light emission period, as shown in FIG. 10. When the image signal line 14 is directly connected to the threshold-voltage holding capacitor $C_s$ without via the switching transistor, as shown in FIG. 11, the potential of the image signal line 14 can be dropped during the light emission period, as shown in FIG. 12, based on a similar concept. According to a third embodiment of the present invention, the circuit in FIG. 11 includes a first power supply line 15 connected to an anode of the OLED, and a second power supply mine 16 connected to the source of the driving transistor $T_d$. In the driving signal shown in FIG. 12, there are provided a first reset period for resetting a charge of the threshold-voltage holding capacitor $C_s$, and a second reset period for resetting a charge of the OLED.

As is clear from the configuration shown in FIG. 11, by decreasing the potential of the image signal line 14, the potential difference between the gate and the source of the driving transistor $T_d$ can be decreased via the threshold-voltage holding capacitor $C_s$. As a result, the contrast ratio in the pixel circuit can be improved like in the first and the second embodiments.

In the image display apparatus of a multi-color display in which three primary-color pixels of red, green, and blue form one picture element, a satisfactory white display can be obtained without lowering the contrast ratio, by arranging $V_{data}$ of the maximum gradation to the maximum voltage of the image signal, and by varying the reduction range of $V_{gs}$ for each color, like in the first and the second embodiments.

It is preferable that the condition for decreasing the potential of the image signal line 14 is differentiated between when the light emission brightness of the OLED is at the low gradation level and when the light emission brightness of the OLED is at the high gradation level. More preferably, the change amount (decrease amount) of the potential of the image signal line 14 is set large when the light emission brightness is at the low gradation level and is set stall when the light emission brightness is at the high gradation level. The low gradation level and the high gradation level are not absolute values, and show a size relationship of light emission brightness at both levels. For example, to obtain a satisfactory white display and a desirable contrast ratio, at the time of varying the potential of the image signal line 14 based on the above processing method, assume that light emission brightness A when the change amount of the potential of the image signal line 14 is $\Delta V_A$ and light emission brightness B when the change amount of the potential of the image signal line 14 is $\Delta V_B$ have a relationship of $\Delta V_A > \Delta V_B$. In this case, the light emission brightness A can be set as the low gradation level, and the light emission brightness B can be set as the high gradation level.

As a control unit that changes the potential of the image signal line 14, there is a data driver (X driver) 30 connected to the image signal line 14, as shown in FIG. 13. When image data and image potential adjusting data are input to the data driver 30 via a data selector (not shown), both data are combined within the data driver 30, and the combined data is supplied to the image signal line 14.

Furthermore, a difference of control mode following the difference of configuration about whether to drive the high-potential side or the low-potential side or both is also similar to that of the first embodiment. The potential of the image signal line 14 can be changed toward the direction determined according to the driving system.

As explained above, according to the image display apparatus of the third embodiment, the potential of the image signal line is changed to lower the voltage application to the driving transistor that controls the light emission of the organic light-emitting element during the light emission period of the organic light emitting element. Therefore, light emission brightness of the organic light-emitting element at the low gradation level can be decreased. As a result, the contrast ratio in the image display apparatus can be improved.

According to the present invention, light emission brightness of the light emitting unit can be made sufficiently small at the low gradation level, by controlling the potential of the first terminal to the second terminal of the driver unit at a higher value or a lower value than the threshold voltage of the driver unit according to the characteristic of the driver unit.

According to the present invention, a voltage applied to the first terminal or the second terminal of the driver unit is differentiated between when the light emission brightness of the light emitting unit is at the high gradation level and when the light emission brightness of the light emitting unit is at the low gradation level during the light emission period of the light emitting unit. With this arrangement, the light emission brightness at the low gradation level can be made sufficiently small and a contrast ratio in the image display apparatus can be improved.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image display apparatus, comprising:

a light emitting unit configured to emit light by current flowing through the light emitting unit;

a driving transistor including a gate electrode, a drain electrode, and a source electrode, the driving transistor being configured to control light emission of the light emitting unit based on a potential difference between the gate electrode and the source electrode;

a threshold-voltage detecting transistor; and a control unit configured to:

control a difference of a potential of the gate electrode and a potential of the source electrode to be a threshold voltage of the driving transistor by increasing a potential of a merge line electrically connected, via a switching transistor, to the gate electrode during a threshold-voltage detection period and passing, by short-circuiting of the gate electrode and the drain electrode, a current from the gate electrode to the drain electrode, control the potential of the gate electrode and the potential of the drain electrode to be a same potential during a write period by decreasing the potential of the merge line and connecting together the gate electrode and the drain electrode, and control the potential difference between the gate electrode and the source electrode to be a value lower than the threshold voltage of the driving transistor by decreasing a potential of a control line electrically connected to the gate electrode below a potential of the control line during a preparation period and increasing the potential of the merge line during a light emission period of the light emitting unit, and to have a variation width that is in inverse proportion to a gradation level of light emission brightness, by varying the potential difference between the gate electrode and the source electrode when the driving transistor has a characteristic that an absolute value of a current flowing through the source electrode increases with the potential difference between the gate electrode and the source electrode, wherein the image display apparatus is a multi-color image display apparatus, and wherein a value of an image signal voltage corresponding to a maximum gradation level is arranged to a maximum value of the image signal voltage and a variation width of the potential difference between the gate electrode and the source electrode is varied for different colors of the emitted light.

2. A method of driving an image display apparatus that includes a light emitting unit, a driving transistor, and a threshold-voltage detecting transistor, the driving transistor including a gate electrode, a drain electrode and a source electrode, and the driving transistor being electrically connected to a light emitting element, the method comprising:

controlling a difference of a potential of the gate electrode and a potential of the source electrode to be a threshold voltage of the driving transistor by increasing a potential of a merge line electrically connected, via a switching transistor, to the gate electrode during a threshold-voltage detection period and passing, by short-circuiting of the gate electrode and the drain electrode, a current from the gate electrode to the drain electrode, controlling the potential of the gate electrode and the potential of the drain electrode to be a same potential during a write period by decreasing the potential of the merge line and connecting together the gate electrode and the drain electrode, and controlling the potential difference between the gate electrode and the source electrode to be a value lower than the threshold voltage of the driving transistor by decreasing a potential of a control line electrically connected to the gate electrode below a potential of the control line during a preparation period and increasing the potential of the merge line during a light emission period of the light emitting unit, and to have a variation width that is in inverse proportion to a gradation level of light emission brightness, by varying the potential difference between the gate electrode and the source electrode when the driving transistor has a characteristic that an absolute value of a current flowing through the source electrode increases with the potential difference between the gate electrode and the source electrode, wherein the image display apparatus is a multi-color image display apparatus, and wherein a value of an image signal voltage corresponding to a maximum gradation level is arranged to a maximum value of the image signal voltage and a variation width of a potential difference between the gate electrode and the source electrode is varied for different colors of the emitted light.

* * * * *